US009566614B2

(12) United States Patent
Kim et al.

(10) Patent No.: US 9,566,614 B2
(45) Date of Patent: Feb. 14, 2017

(54) DRY SEPARATION APPARATUS AND DRY SEPARATION METHOD

(71) Applicant: Korea Institute of Geoscience and Mineral Resources, Daejeon (KR)

(72) Inventors: Byoung-Gon Kim, Daejeon (KR); Ho-Seok Jeon, Daejeon (KR); Jeong Yun Kim, Daejeon (KR); Soo Bok Jeong, Daejeon (KR); Davaasuren Jambal, Daejeon (KR)

(73) Assignee: KOREA INSTITUTE OF GEOSCIENCE AND MINERAL RESOURCES (KR)

( * ) Notice: Subject to any disclaimer, the term of this patent is extended or adjusted under 35 U.S.C. 154(b) by 0 days.

(21) Appl. No.: 14/410,791

(22) PCT Filed: Sep. 11, 2013

(86) PCT No.: PCT/KR2013/008217

§ 371 (c)(1),
(2) Date: Dec. 23, 2014

(87) PCT Pub. No.: WO2014/163258

PCT Pub. Date: Oct. 9, 2014

(65) Prior Publication Data

US 2016/0023246 A1 Jan. 28, 2016

(30) Foreign Application Priority Data

Apr. 5, 2013 (KR) ..... 10-2013-0037326
Apr. 5, 2013 (KR) ..... 10-2013-0037382
(Continued)

(51) Int. Cl.
*B03B 7/00* (2006.01)
*B07B 4/08* (2006.01)
*B07B 13/00* (2006.01)

(52) U.S. Cl.
CPC ..... *B07B 4/08* (2013.01); *B07B 13/003* (2013.01)

(58) Field of Classification Search
CPC ..... B07B 4/08; B07B 1/00; B07B 1/28; B07B 13/00; B07B 13/003; B03B 4/02; B03B 4/06; B03B 4/065
(Continued)

(56) References Cited

U.S. PATENT DOCUMENTS 1,632,520 A * 6/1927 Steele ..... B07B 13/00 209/400
1,786,740 A 12/1930 Davis
(Continued)

FOREIGN PATENT DOCUMENTS

JP 1997216226 8/1997
JP 4601236 10/2010
(Continued)

OTHER PUBLICATIONS

Australian Office Action—Australian Application No. 2013385726 issued on Sep. 4, 2015, citing U.S. Pat. No. 1,786,740 and U.S. Pat. No. 5,419,442.
(Continued)

*Primary Examiner* — Terrell Matthews
(74) *Attorney, Agent, or Firm* — Cantor Colburn LLP

(57) ABSTRACT

Provided is a dry separation apparatus including: a main body; a first deck; a plurality of guides; a supply part; an air blow fan; and a vibration part. A dry separation method includes: supplying an object to be separated to a top surface of a first deck provided with a plurality of punches; sending, by an air blow fan, air to the punches (first punches); and horizontally vibrating, by a vibration part, the first deck so as to discharge particles which have different specific gravities of the object to be separated and a moveable force
(Continued)

exerted by air passing the first punches through different passages.

11 Claims, 11 Drawing Sheets

(30) Foreign Application Priority Data

Apr. 5, 2013 (KR) ..... 10-2013-0037416
Apr. 5, 2013 (KR) ..... 10-2013-0037483
Aug. 6, 2013 (KR) ..... 10-2013-0093364

(58) Field of Classification Search
USPC ..... 209/20
See application file for complete search history.

(56) References Cited

U.S. PATENT DOCUMENTS 2,161,500 A * 6/1939 Bird ..... B03B 4/02 209/466
2,269,307 A * 1/1942 Dickerson ..... B03B 4/02 209/467
2,281,174 A * 4/1942 Steele ..... B07B 13/113 209/480
2,309,355 A * 1/1943 Peale ..... B03B 4/02 209/467
2,513,960 A * 7/1950 Ore ..... B03B 4/005 209/468
2,598,934 A * 6/1952 Ore ..... B03B 4/00 209/468
3,108,950 A * 10/1963 Buckley ..... B03B 4/02 209/20
3,667,601 A * 6/1972 Johnston ..... B03B 4/065 209/466
5,419,442 A 5/1995 Wright, Jr.
6,758,342 B1 7/2004 Harada
9,346,082 B2 * 5/2016 Thomas ..... B07B 13/113

FOREIGN PATENT DOCUMENTS

KR 100516002 9/2005
KR 100872744 12/2008
KR 1020100013463 2/2010

OTHER PUBLICATIONS

International Search Report—PCT/KR2013/008217 dated Dec. 23, 2013.

* cited by examiner

DRY SEPARATION APPARATUS AND DRY SEPARATION METHOD

TECHNICAL FIELD

The present invention relates to a dry separation apparatus and a dry separation method, and more particularly, to a dry separation apparatus and a dry separation method capable of separating particles with different specific gravities using the difference in specific gravities. More particularly, the present invention relates to a dry separation apparatus and a dry separation method capable of sorting at least two particles with different specific gravities using a shape and a disposition of a guide.

BACKGROUND ART

An apparatus for separating particles from each other using a difference in specific gravities has been widely used in a dry coal preparation field, a sorting field for recycling waste plastic, a field for purifying precious metals such as rare earth resources, and the like.

In particular, in the dry coal preparation field, a run of mine coal which is mined from a coal bed contains a large amount of coal and has a mixture of clean coal having a small amount of ash and a gangue which is a fragment of rock. When the clean coal includes the gangue, a quantity of heat may be reduced and harmful gas (SOx) may occur, during a combustion process and mica, chlorite in the gangue and alkaline components (K2O and Na2O) which are included in clay, and the like have a reduced melting point of ash during a combustion process, such that slagging or fouling may occur inside a boiler of a thermal power plant, which is a factor of shortening lifespan of the boiler.

Therefore, to improve the combustion efficiency and extend the lifespan of the boiler, attempts to develop a technology for removing the gangue mixed in the run of mine coal by a physical method have been conducted.

Korean Patent No. 1010940 which is the related art discloses an apparatus for improving low grade coal into high quality coal including: an abrasion crusher which includes a main body of a crusher which is provided with a receiving part to receive both of low grade coal of which the ash content is a predetermined level or more and water, a plurality of friction balls which is received in a receiving part of a main body of the crusher to crush the coal by collision and friction with the coal, and an agitator which is rotatably disposed in the main body of the crusher to agitate the coal and the friction ball so as to provide mutual collision and friction between the coal and the friction ball; a screen which is installed over the receiving part of the abrasion crusher and provided with a plurality of transmit holes through which only particles having a predetermined size or less may pass; and a collector supply apparatus which supplies a collector hydrophobicizing the crushed coal particles to the receiving part so as to make the coal particles crushed by the abrasion crusher float toward a top portion of the receiving part. In summary, the related art is concerned with the run of mine coal to be sorted into clean coal particles and gangue particles by flotation.

However, the related art requires a post-treatment process of performing dehydration and drying the processed coal and therefore a lot of costs may be required.

Therefore, there is a need to develop various dry separation apparatuses for solving the above problems.

RELATED ART DOCUMENT

Patent Document (Patent Document 1) Korean Patent No. 1010940 (Jan. 19, 2011)

DISCLOSURE

Technical Problem

An object of the present invention is to provide a dry separation apparatus which does not require a post-treatment process by sorting particles included in an object to be separated into particles with a large specific gravity and particles with a small specific gravity using a difference in specific gravities.

Technical Solution

In one general aspect, a dry separation apparatus 1000 includes: a main body 100 of which the top surface is formed as an inclined surface 110 which is inclined to one side in a front and rear direction and one side in a left and right direction, the inclined surface 110 being opened; a first deck 210 seated inside the inclined surface 110 and provided with a plurality of first punches 211; a plurality of guides 220 coupled with a top surface of the first deck 210; a supply part 300 supplying an object to be separated to the top surface of the first deck 210; an air blow fan 400 installed inside the main body 100 and sending air to the first punch 211; and a vibration part 500 horizontally vibrating the first deck 210 to discharge particles with a large specific gravity and particles with a small specific gravity of the object to be separated through different passages.

The dry separation apparatus may further include: a second deck 230 provided between the first deck 210 and the air blow fan 400 and provided with a plurality of second punches 231 which split the air sent from the air blow fan 400 at a uniform size; and a frame 240 inclinedly seated inside the inclined surface 110 in an inclined direction of the inclined surface 110, while having the first deck 210 and the second deck 230 into a top surface and a bottom surface thereof, respectively.

In the second deck 230, the second punch 231 may be formed to be wider than the first punch 211.

The dry separation apparatus may further include: a first ripple 250 arranged between a top end of a second corner 213 and a top end of a fourth corner 215 when corners of the first deck 210 each are a first corner 212, the second corner 213, a third corner 214, and the fourth corner 215 in a highly placed order; a second ripple 260 arranged between a top end of the first corner 212 and a top end of the third corner 214; and a blocking wall 270 enclosing the top end of the first corner 212 and the top end of the second corner 213.

The vibration part 500 may include an angle control plate 510 which is hinged with one side in a horizontal direction of the first deck 210 and a vibration member 520 which is installed at the angle control plate 510 to horizontally apply a vibration.

The vibration part 500 may include a piston 550 which periodically applies a horizontally pushing force to the first deck 210 to the first deck 210 to generate a vibration and a crank shaft 560 which horizontally reciprocates the piston.

When corners of the first deck 210 each are a first corner 212, a second corner 213, a third corner 214, and a fourth corner 215 in a highly placed order, a top end of the fourth corner 215 and a top end of the third corner 214 may be partitioned into a first discharge space 216 adjacent to the fourth corner 215 and a second discharge space 217 adjacent to the third corner 214 by a first partition wall 280 and a second partition wall 290, and the particles with a small specific gravity of the object to be separated supplied to the first deck 210 may be discharged to the first discharge space 216 and the particles with a relatively larger specific gravity are discharged to the second discharge space 217.

The first deck 210 may have a top surface as a stepped surface 219.

The vibration part 500 may horizontally vibrate the first deck 210 to discharge particles, which have the smallest specific gravity and the highest moveable force, between the second corner 213 and the fourth corner 215 along the guides 220, discharge particles with the second smallest specific gravity between the third corner 214 and the fourth corner 215 but to a first discharge space 216 adjacent to the fourth corner 215, discharge particles with the third smallest specific gravity between the third corner 214 and the fourth corner 215 but discharge the particles with the third smallest specific gravity having a lower moveable force than that of particles with the largest specific gravity to a second discharge space 217 adjacent to the third corner 214, and discharge the particles with the largest specific gravity between the first corner 212 and the third corner 214 along the guide 220.

The dry separation apparatus may further include: a suction part 700 installed over the main body 100 to suck dust generated during a sorting process.

The dry separation apparatus 1000 may satisfy the following Equation 1 in a state in which a driving frequency of the air blow fan 400 is constant and a vibration frequency applied to the first deck 210 is constant.

$$CR=0.2173FR^2-7.6525FR+96.385 \quad \text{<Equation 1>}$$

(however, CR represents a recovery rate of particles to be recovered included in the object to be separated and FR represents a supply amount of the object to be separated per hour by the supply part 300, in which FR=2 to 6).

The dry separation apparatus 1000 may satisfy the following Equation 2 in the state in which the vibration frequency applied to the first deck 210 is constant and the supply amount of the object to be separated by the supply part 300 per hour is constant.

$$CR=0.0221ABF^2-1.4684ABF+91.983 \quad \text{<Equation 2>}$$

(however, CR represents a recovery rate of particles to be recovered included in the object to be separated and ABF represents a driving frequency of the air blow fan 400, in which ABF=30 to 60)

The object to be separated may be a crushed matter of a run of mine coal.

In another general aspect, a dry separation method includes: a first step of supplying an object to be separated to a top surface of a first deck 210 which is inclinedly provided to one side in a front and rear direction and one side in a left and right direction and is provided with a plurality of punches 211; a second step of sending, by an air blow fan 400, air to the first punches 211; and a third step of horizontally vibrating, by a vibration part 500, the first deck 210 so as to discharge particles which have different specific gravities of the object to be separated and have a moveable force exerted by air passing through the first punches 211 through different passages, wherein in the second step, the air sent from the air blow fan 400 is split at a uniform size, passing through a second deck 230 which is provided between the first deck 210 and the air blow fan 400 and is provided with a plurality of second punches 231.

In the second deck 230, the second punch 231 may be formed to be wider than the first punch 211.

When corners of the first deck 210 each are a first corner 212, a second corner 213, a third corner 214, and a fourth corner 215 in a highly placed order, a top end of the fourth corner 215 and a top end of the third corner 214 may be partitioned into a first discharge space 216 adjacent to the fourth corner 215 and a second discharge space 217 adjacent to the third corner 214 by a first partition wall 280 and a second partition wall 290 and the vibration part 500 may horizontally vibrate the first deck 210 to discharge particles, which have the smallest specific gravity and the highest moveable force, between the second corner 213 and the fourth corner 215 along the guides 220 on the top surface of the first deck 210, discharge particles with the second smallest specific gravity between the third corner 214 and the fourth corner 215 but to a first discharge space 216 adjacent to the fourth corner 215, discharge particles with the third smallest specific gravity between the third corner 214 and the fourth corner 215 but discharge the particles with the third smallest specific gravity having a lower moveable force than that of particles with the largest specific gravity to a second discharge space 217 adjacent to the third corner, and discharge the particles with the largest specific gravity between the first corner 212 and the third corner 214 along the guide 220.

The vibration part 500 may include an angle control plate 510 which is hinged with one side in a horizontal direction of the first deck 210 and a vibration member 520 which is installed at the angle control plate 510 to horizontally apply a vibration.

The vibration part 500 may include a piston 550 which periodically applies a horizontally pushing force to the first deck 210 to the first deck 210 to generate a vibration and a crank shaft 560 which horizontally reciprocates the piston.

In the third step, the top surface of the first deck 210 may be formed as the stepped surface 218 to prevent the particles with a large specific gravity of the particles with different specific gravities from being discharged in the same direction as the particles with a small specific gravity.

Further, the third step may satisfy the following Equation 1 in the state in which the driving frequency of the air blow fan 400 is constant and the vibration frequency applied to the first deck 210 is constant.

$$CR=0.2173FR^2-7.6525FR+96.385 \quad \text{<Equation 1>}$$

(however, CR represents the recovery rate of particles to be recovered included in the object to be separated and FR represents the supply amount of the object to be separated per hour in the first step, in which FR=2 to 6).

The third step may satisfy the following Equation 2 in the state in which the vibration frequency applied to the first deck 210 is constant and the supply amount of crushed matters of run of mine coal in the step 1 is constant.

$$CR=0.0221ABF^2-1.4684ABF+91.983 \quad \text{<Equation 2>}$$

(however, CR represents the recovery rate of particles to be recovered included in the object to be separated and ABF represents the driving frequency of the air blow fan 400, in which ABF=30 to 60)

The object to be separated may be a crushed matter of a run of mine coal.

Advantageous Effects

As set forth above, according to the exemplary embodiments of the present invention, the dry separation apparatus and the dry separation method may not require the post-treatment process of performing dehydration and drying, because the particles included in the object to be separated are sorted from each other by the drying method using the difference in specific gravities.

BEST MODE

Figure 1:
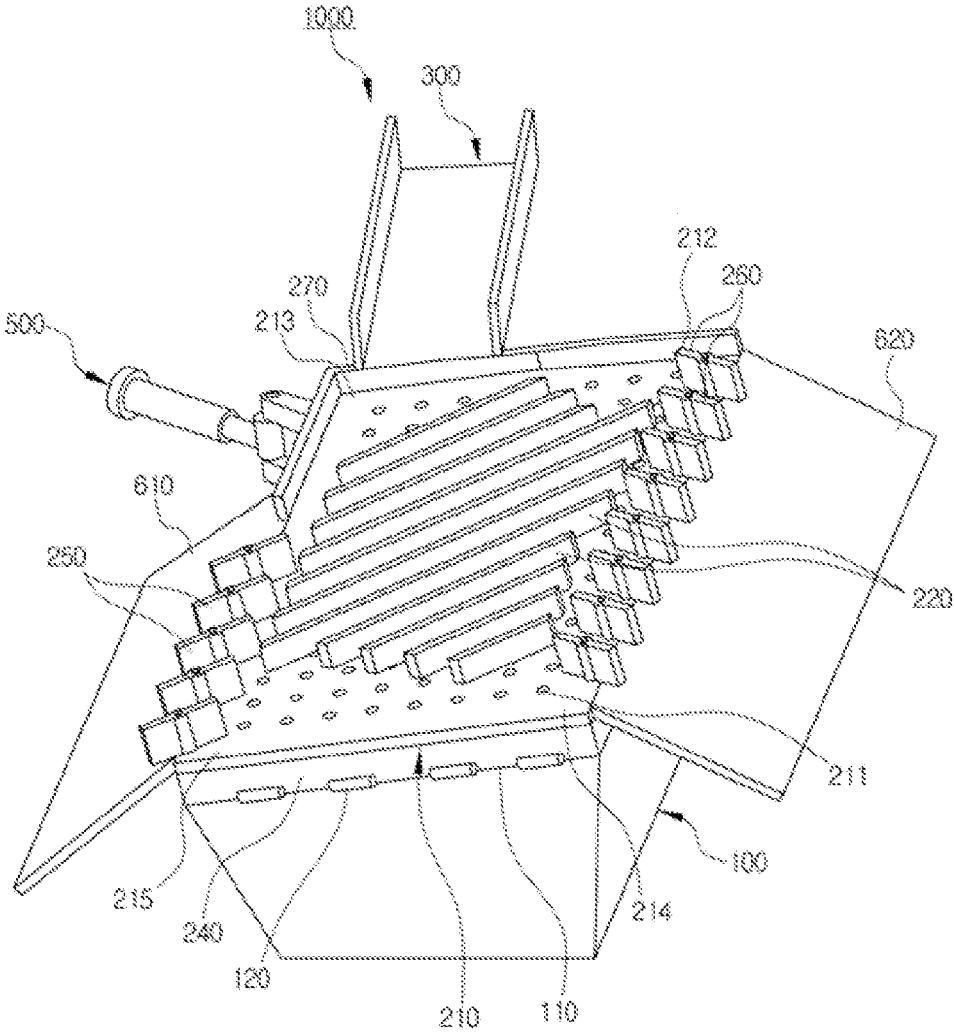
FIG. 1 is a perspective view of a dry separation apparatus according to an exemplary embodiment of the present invention.

Hereinafter, a technical spirit of the present invention will be described in more detail with reference to the accompanying drawings.

However, the accompanying drawings are only examples shown in order to describe the technical idea of the present invention in more detail. Therefore, the technical idea of the present invention is not limited to shapes of the accompanying drawings.

In representing a direction of the present invention, a vertical direction in the drawings is defined to be an up and down direction, a lateral direction in the drawings is defined to be a left and right direction, a horizontal direction in the drawings is defined to be a front and rear direction, and the lateral direction and the horizontal direction in the drawings are collectively defined to be a horizontal direction.

Figure 2:
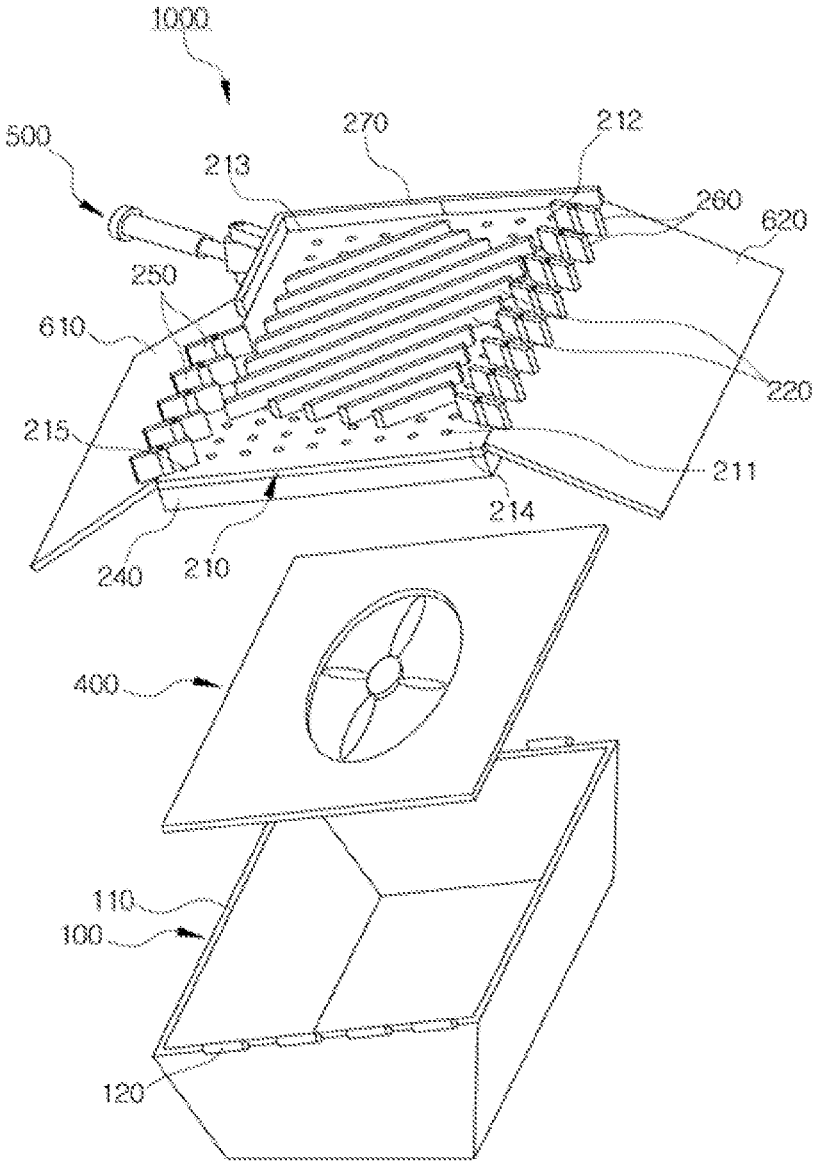
FIG. 2 is an exploded perspective view of the dry separation apparatus according to the exemplary embodiment of the present invention.

FIG. 1 is a perspective view of a dry separation apparatus according to an exemplary embodiment of the present invention and FIG. 2 is an exploded perspective view of the dry separation apparatus according to the exemplary embodiment of the present invention.

As illustrated in FIGS. 1 and 2, a dry separation apparatus 1000 according to an exemplary embodiment of the present invention is configured to include a main body 100, a first deck 210, guides 220, a supply part 300, an air blow fan 400, and a vibration part 500.

The main body 100 has a rectangular parallelepiped shape which is widened upward and is provided with an inclined surface 110 of which the top surface is inclined from left to right while being inclined from a front side to a rear side, in which a center of the inclined surface 110 is opened and an edge of the inclined surface 110 is arranged with a plurality of support members 120.

In this case, the inclined surface 110 may be formed to have a form which is inclined from left to right while being inclined from a front side to a rear side but the present invention is not limited thereto, and therefore any form in which the inclined surface 110 is inclined to one side in the front and rear direction and one side in the left and right direction may be applied without limit.

The support member 120 is a component to support components which are seated inside the inclined surface 110 and may have a cylindrical shape, but the present invention is not limited thereto.

The first deck 210 has a plate shape and is supported by the support member 120 while being inclinedly seated in the inclined surface 110 in an inclined direction of the inclined surface 110 and the plurality of first punches 211 are densely formed in the inclined direction of the inclined surface 110. Further, the first deck 210 may be formed in even a mesh plate but the present invention is not limited thereto.

When corners of the first deck 210 each are referred to as a first corner 212, a second corner 213, a third corner 214, and a fourth corner 215 in a highly placed order, the guides 220 are extendedly formed toward the fourth corner 215 but many of the guides 220 are arranged in a direction from the second corner 213 toward the third corner 214 and thus are coupled with a top surface of the first deck 210.

The supply part 300 supplies an object to be separated to a position adjacent to the second corner 213 of the top surface of the first deck 210. In this case, the first punches 211 may be formed to have a narrower area than particles included in the object to be separated so as to prevent the object to be separated, which is supplied to the top surface of the first deck 210, from being chaotically input.

The air blow fan 400 is installed inside the main body 100 to send air to the first punches 211.

The vibration part 500 may be configured as a vibrator which is hinged with one end of the first deck 210 and serve to horizontally vibrate the first deck 210 so as to discharge particles, which have a small specific gravity of the object to be separated supplied to the top surface of the first deck 210 and have a moveable force exerted by air passing the first punches 211, between the second corner 213 and the fourth corner 215 along the guides 220 and discharge particles having a relatively larger specific gravity between the first corner 212 and the third corner 214 along the guides 220.

As set forth above, the dry separation apparatus 1000 according to the exemplary embodiments of the present invention may not require the post-treatment process of performing dehydration and drying by sorting the particles included in the object to be separated from each other by the drying method using the difference in specific gravities.

Meanwhile, the dry separation apparatus 1000 according to the exemplary embodiments of the present invention may be configured to further include a first guide member 610 installed between the second corner 213 and the fourth corner 215 to guide particles with a small specific gravity discharged between the second corner 213 and the fourth corner 215 downwardly and a second guide member 620 installed between the first corner 212 and the third corner 214 to guide particles with a relatively larger specific gravity disposed between the first corner 212 and the third corner 214 downwardly.

Figure 3:
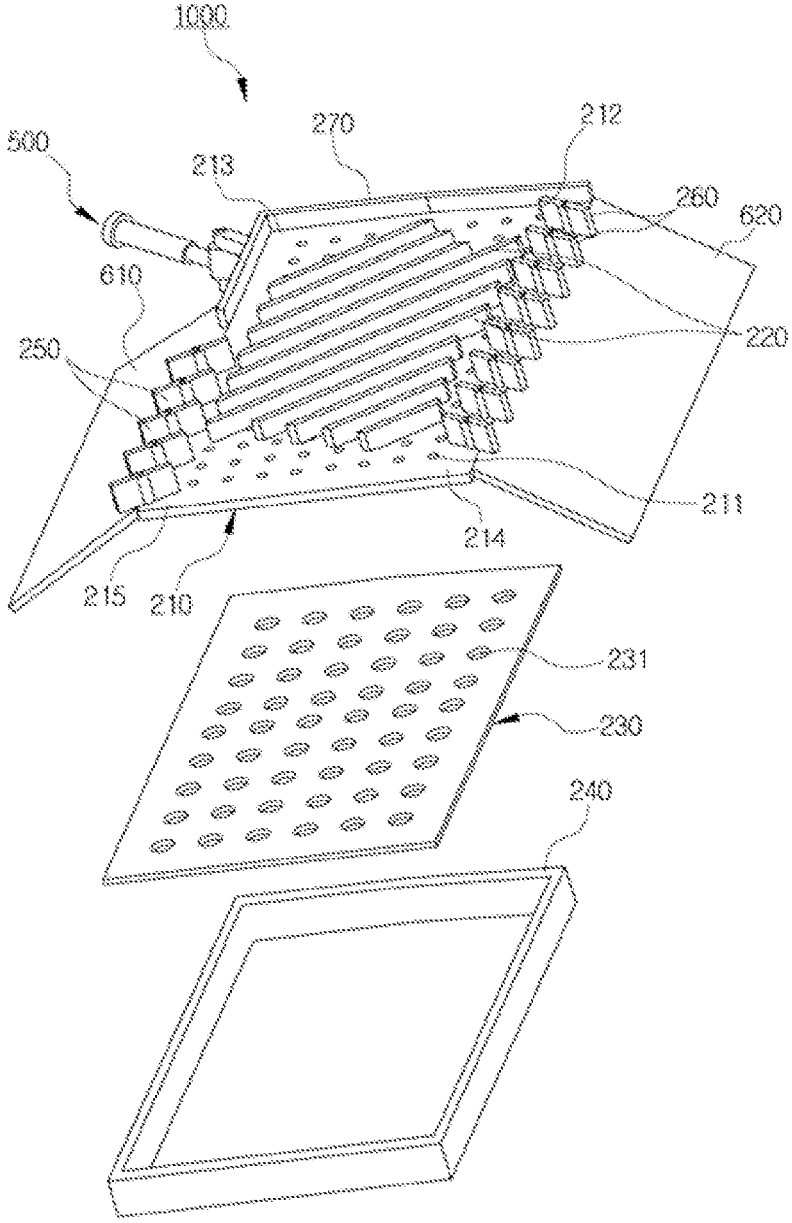
FIG. 3 is an exploded perspective view of a first deck, a second deck, and a frame according to an exemplary embodiment of the present invention.

FIG. 3 is an exploded perspective view of the first deck, a second deck, and a frame according to an exemplary embodiment of the present invention.

As illustrated in FIG. 3, the dry separation apparatus 1000 according to the exemplary embodiments of the present invention may be configured to further include a second deck 230 and a frame 240 which may split air sent from the air blow fan 400 at a uniform size and then send the air to the first punch 211.

The second deck 230 is formed in a plate shape and thus is installed between the first deck 210 and the air blow fan 400 and is densely provided with a plurality of second punches 231 which split the air sent from the air blow fan 400 at a uniform size. In this case, the second punch 231 is formed to have a wider area than that of the first punch 211 to smoothly pass the air sent from the air blow fan 400.

The frame 240 has a plate shape which is opened in an up and down direction and has the first deck 210 and inclinedly seated inside the inclined surface 110 in an inclined direction of the inclined surface 110, inserting the second deck 230 into the top and the bottom surfaces of the frame 240, respectively.

Therefore, a sorting apparatus according to the exemplary embodiment of the present invention is configured to further include the second deck 230 and the frame 240, and as a result, splits the air sent from the air blow fan 400 at a uniform size by passing the air through the second punches 231 and then supplies the split air to the first punches 211.

In this case, the particles with a small specific gravity of the object to be separated which is supplied to the top surface of the first deck 210 have a uniform moveable force at each area distributed on the top surface of the first deck 210 by the air having a uniform size which passes through the first punches 211.

Meanwhile, referring to FIGS. 1 to 3, the dry separation apparatus 1000 according to the exemplary embodiment of the present invention may be configured to further include a first ripple 250, a second ripple 260, and a blocking wall 270.

The first ripple 250 is configured to be arranged between a top end of the second corner 213 and a top end of the fourth corner 215 and guides the particles with a small specific gravity to be discharged between the second corner 213 and the fourth corner 215 in one direction. The drawings illustrate an exemplary embodiment in which the first ripple 250 guides the particles with a small specific gravity to be toward the fourth corner 215, but the present invention is not limited thereto.

The second ripple 260 is configured to be arranged between a top end of the first corner 212 and a top end of the third corner 214 and guides the particles with a relatively larger specific gravity to be discharged between the first corner 212 and the third corner 214 in one direction. The drawings illustrate an exemplary embodiment in which the second ripple 260 guides the particles with a relatively larger specific gravity to be toward the third corner 214, but the present invention is not limited thereto.

The blocking wall 270 is configured to enclose the top end of the first corner 212 and the top end of the second corner 213 and serves to prevent the object to be separated, which is supplied to the top surface of the first deck 210, from being chaotically output between the first corner 212 and the second corner 213.

Figure 4:
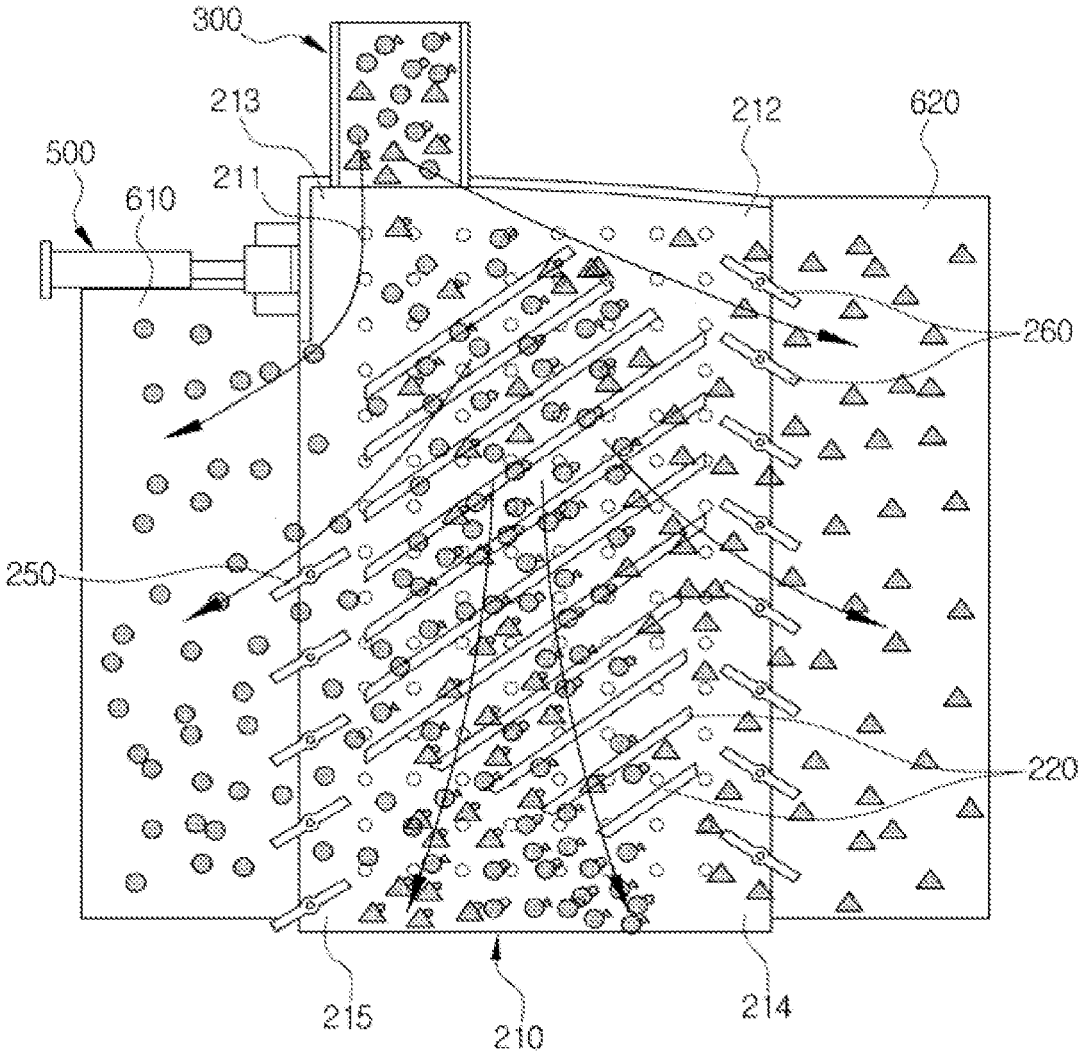
FIG. 4 is an operation diagram of the dry separation apparatus according to the exemplary embodiment of the present invention.

FIG. 4 is an operation diagram of the dry separation apparatus according to the exemplary embodiment of the present invention.

An operation principle of the dry separation apparatus 1000 according to the exemplary embodiment of the present invention will be described with reference to FIG. 4.

First, the supply part 300 supplies an object to be separated to the position adjacent to the second corner 213 of the top surface of the first deck 210. In this case, the blocking wall 270 prevents the object to be separated from being chaotically output between the first corner 212 and the second corner 213.

Next, the air blow fan 400 sends air to the second punches 231. In this case, the air sent from the air blow fan 400 is split at a uniform size by the second punches 231 and then is sent to the first punches 211.

In this case, due to the air passing through the first punches 211, the particles included in the object to be separated which is supplied to the first deck 210 have a high moveable force in a low specific gravity order.

In more detail, due to the air passing through the first punches 211, the particles included in the object to be separated have different moveable forces depending on a specific gravity and the particles with a small specific gravity have a large moveable force and the particles with a large specific gravity have a small moveable force.

In FIG. 4, particles with different specific gravity are illustrated by different figures to more simply indicate a moving passage of particles included in the object to be separated. Particles with the smallest specific gravity are illustrated by a circle, particles with the second smallest specific gravity are illustrated by a circle with a small triangle, and particles with the third smallest specific gravity are illustrated by a triangle with a small circle and particles with the largest specific gravity are illustrated by a triangle.

Next, the vibration part 500 horizontally vibrates to the first deck 210 to discharge the particles with the smallest specific gravity between the second corner 213 and the fourth corner 215 along the guides 220, discharge the particles with the second smallest specific gravity to a position nearest the fourth corner 215 of the third corner 214 and the fourth corner 215, going over the guides 220, discharge the particles with the third smallest specific gravity to a position nearest the third corner 214 of the third corner 214 and the fourth corner 215, going over the guides 220, and discharge the particles with the largest specific gravity between the first corner 212 and the third corner 214 along the guides 220.

In this case, the first ripple 250 serves to rapidly discharge the particles with a small specific gravity, which are discharged between the second corner 213 and the fourth corner 215, from the top surface of the first deck 210 and the second ripple 260 serves to rapidly discharge the particles with a relatively larger specific gravity, which are discharged between the first corner 212 and the third corner 214, from the top surface of the first deck 210, thereby increasing a sort throughput of the object to be separated which is supplied to the top surface of the first deck 210 and thus reducing energy consumption.

As a result, the dry separation apparatus 1000 according to the exemplary embodiment of the present invention may sort the object to be separated using the difference in specific gravities and may sort at least two particles with different specific gravities using the difference in specific gravities.

Figure 5:
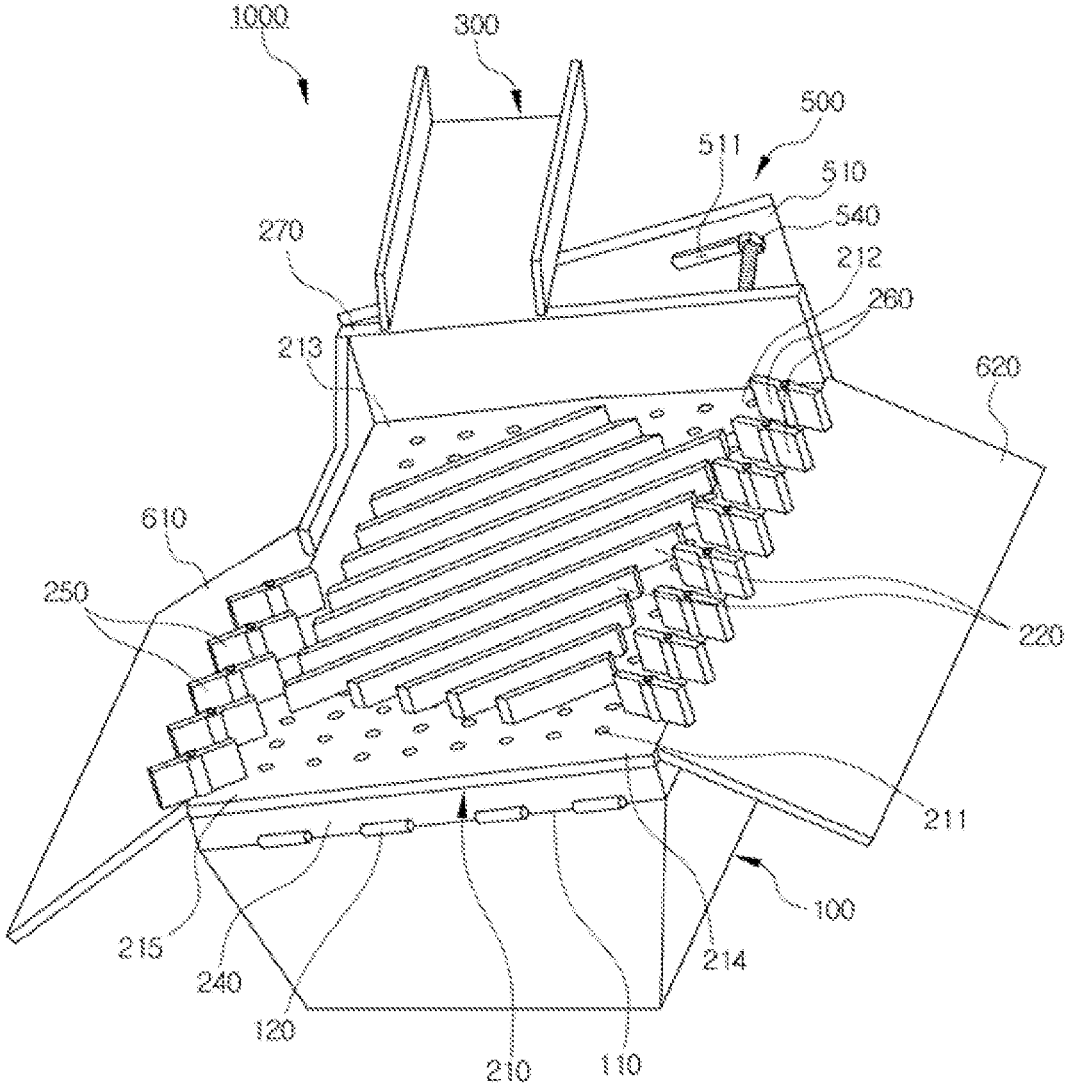
FIG. 5 is a perspective view of a vibration part according to a first exemplary embodiment of the present invention.
Figure 6:
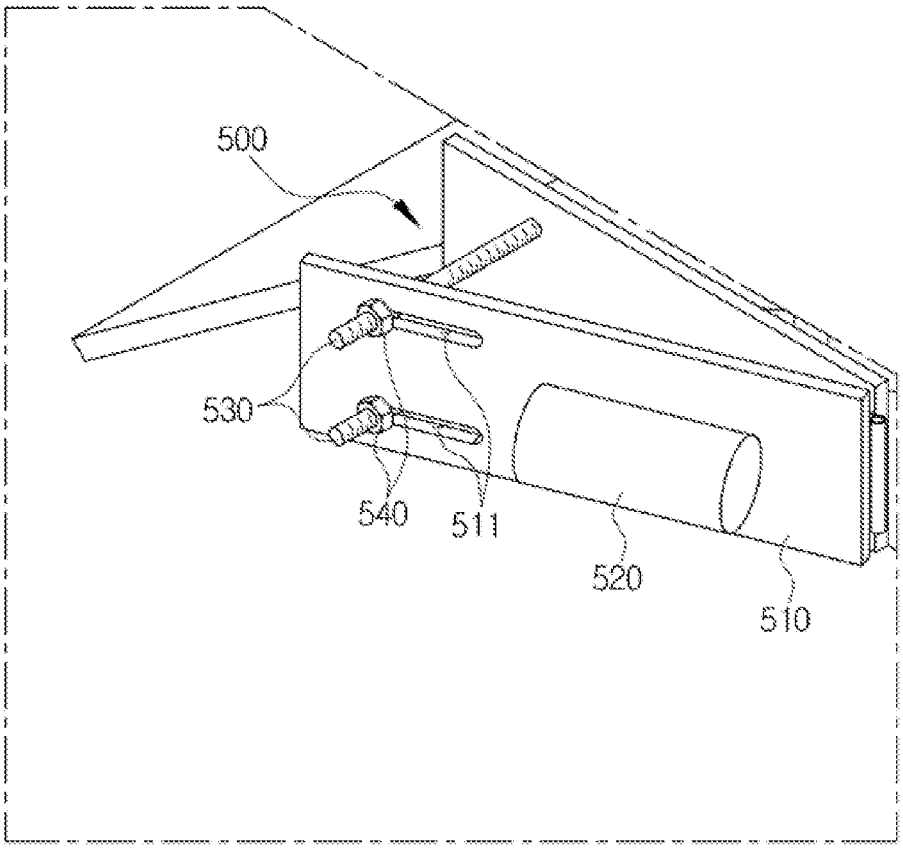
FIG. 6 is an enlarged perspective view of the vibration part according to the first exemplary embodiment of the present invention.

FIG. 5 is a perspective view of a vibration part according to a first exemplary embodiment of the present invention and FIG. 6 is an enlarged perspective view of the vibration part according to the first exemplary embodiment of the present invention.

As illustrated in FIGS. 5 and 6, the vibration part 500 according to the first exemplary embodiment of the present invention is configured to include an angle control plate 510 and a vibration member 520.

The angle control plate 510 has one end hinged with one side in a horizontal direction of the first deck 210 to form a predetermined angle to the one side in the horizontal direction of the first deck 210.

In this case, one end of the angle control plate 510 freely rotates, and thus a predetermined angle formed by the one end of the angle control plate 510 and the one side in the horizontal direction of the first deck 210 may be freely controlled.

The vibration member 520 may be configured as a vibrator and is installed on one side of the angle control plate 510 to serve to horizontally apply a vibration.

In this case, the predetermined angle formed by the one end of the angle control plate 510 and the one side in the horizontal direction of the first deck 210 is controlled, and thus the vibration member 520 may control a vibration direction applied to the first deck 210 through the angle control plate 510.

Further, the vibration part 500 according to the first exemplary embodiment of the present invention may be configured to further include a long hole 511 further provided on the angle control plate 510, a long bolt 530, and a pair of fixed nuts 540 so as to fix the angle control plate 510 at a specific position.

The long hole 511 is formed by punching a predetermined portion in a direction from the other end of the angle control plate 510 toward one end thereof.

The long bolt 530 has one end coupled with the one side in the horizontal direction of the first deck 210 and the other end inserted into the long hole 511 to serve to support the other end of the angle control plate 510.

The pair of fixed nuts 540 are each screwed to one side and the other side of the long bolt 530, having the angle control plate 510 therebetween to adhere a predetermined area of the one side of the angle control plate 510 and a predetermined area of the other side thereof, respectively, such that the angle control plate 510 may be fixed at a specific position.

Figure 7:
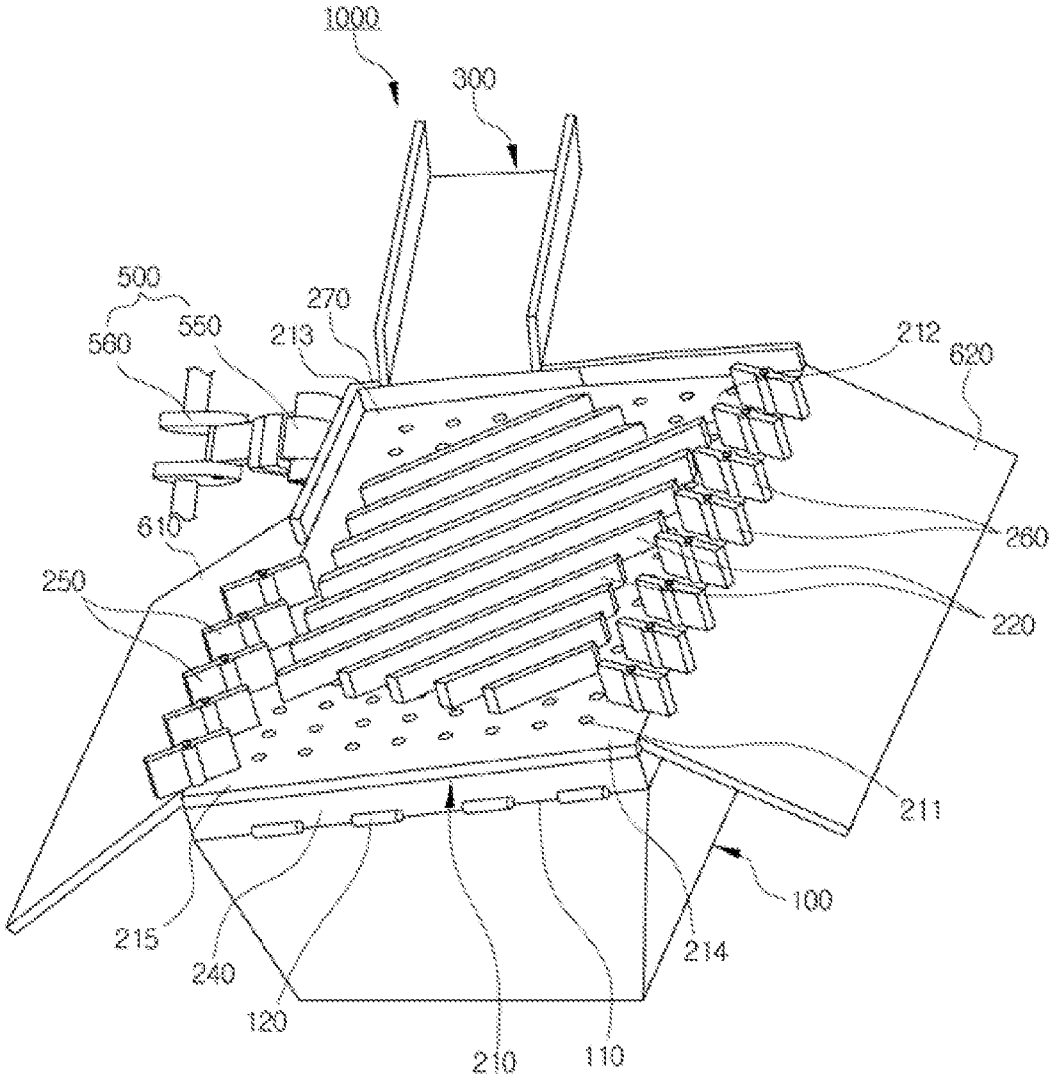
FIG. 7 is a perspective view of a vibration part according to a second exemplary embodiment of the present invention.

FIG. 7 is a perspective view of a vibration part according to a second exemplary embodiment of the present invention.

As illustrated in FIG. 7, the vibration part 500 according to the second exemplary embodiment of the present invention may be configured to include a piston 550 which horizontally applies a pushing force to the first deck 210 to generate a vibration and a crank shaft 560 which is coupled with the piston.

In this case, the object to be separated which is supplied to the top surface of the first deck 210 is applied with only a vibration by the horizontally pushing force by the piston 550, and thus the probability that the particles included in the object to be separated are broken by a collision with each other may be reduced.

Hereinafter, the dry separation apparatus according to various exemplary embodiments of the present invention will be described.

First Exemplary Embodiment

Figure 8:
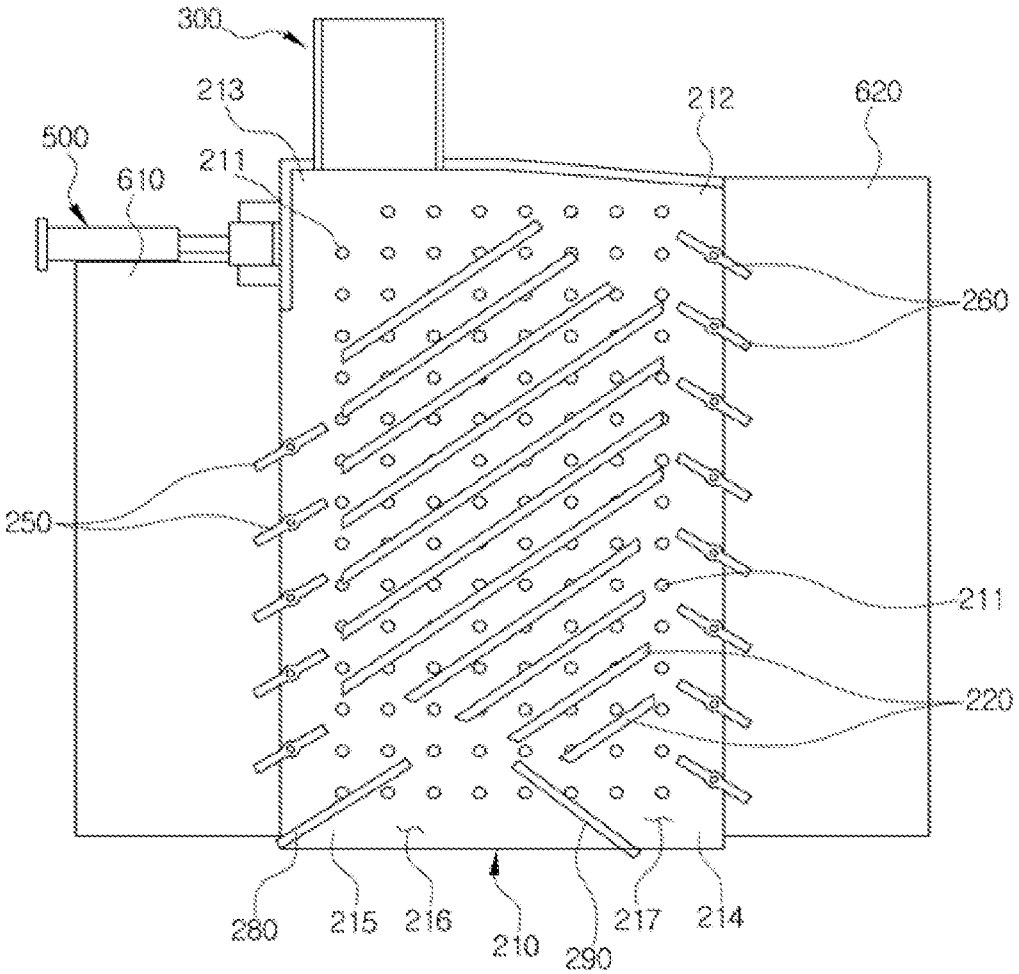
FIG. 8 is a plan view of the dry separation apparatus according to the first exemplary embodiment of the present invention.
Figure 9:
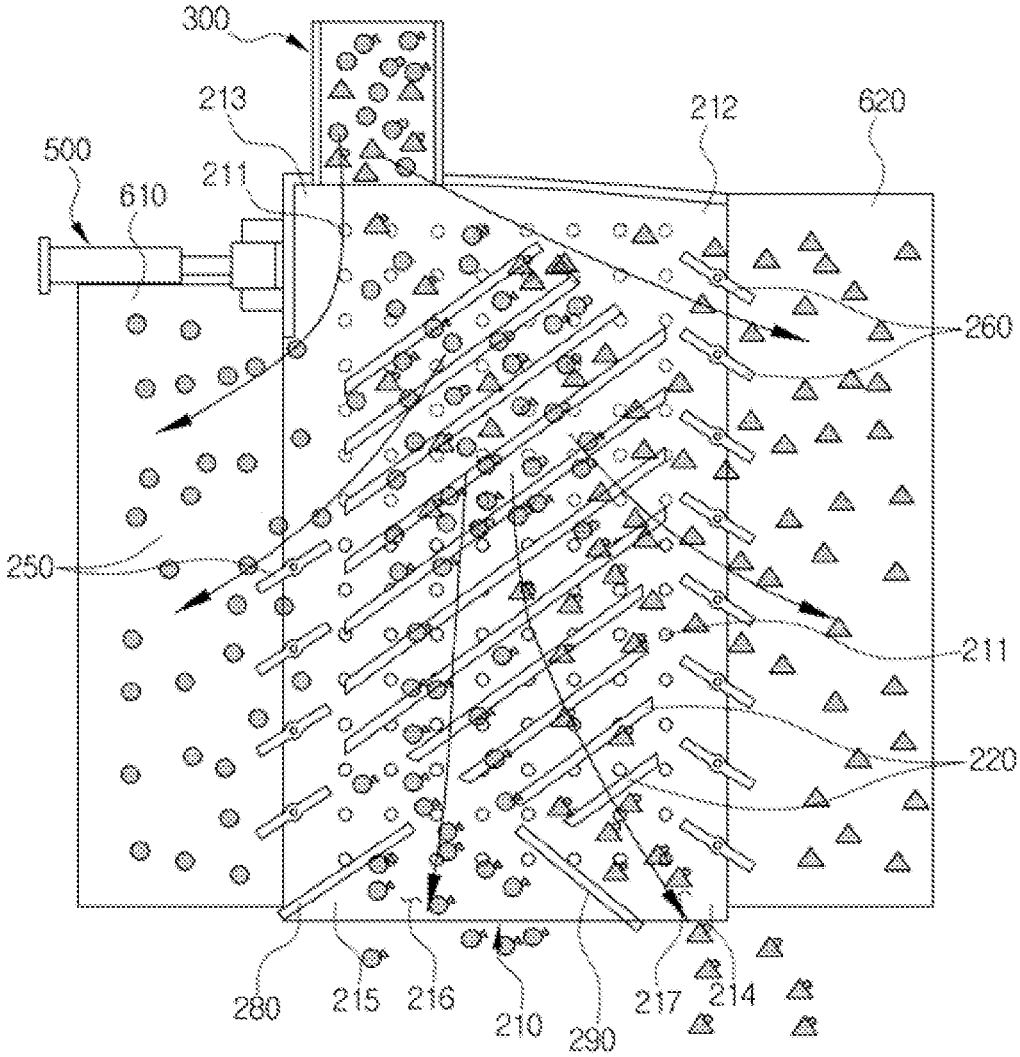
FIG. 9 is an operation diagram of the dry separation apparatus according to the first exemplary embodiment of the present invention.

FIG. 8 is a plan view of the dry separation apparatus according to the first exemplary embodiment of the present invention and FIG. 9 is an operation diagram of the dry separation apparatus according to the first exemplary embodiment of the present invention.

As illustrated in FIG. 8, in the dry separation apparatus 1000 according to the first exemplary embodiment of the present invention, the top end of the fourth corner 215 and the top end of the third corner 214 are partitioned into a first discharge space 216 adjacent to the fourth corner 215 and a second discharge space 217 adjacent to the third corner 214 by a first partition wall 280 and a second partition wall 290.

The first partition wall 280 is formed in a direction from the fourth corner 215 toward the first corner 212, and thus is coupled with the top end of the fourth corner 215. In this case, a bottom end of the first partition wall 280 may be hinged with the top end of the fourth corner 215.

The second partition wall 290 is formed in a direction from the third corner 214 toward the second corner 213, and thus is coupled between the top end of the fourth corner 215 and the top end of the third corner 214. In this case, a bottom end of the second partition wall 290 may be hinged between the top end of the fourth corner 215 and the top end of the third corner 214.

An operation principle of the dry separation apparatus 1000 according to the first exemplary embodiment of the present invention will be described with reference to FIG. 9.

As described in the operation principle of the apparatus for sorting coal according to the exemplary embodiment of the present invention, the vibration part 500 horizontally vibrates the first deck 210 to discharge the particles, which have the smallest specific gravity and the highest moveable force, between the second corner 213 and the fourth corner 215 along the guides 220, discharge the particles with the second smallest specific gravity between the third corner 214 and the fourth corner 215, going over the guides 220, discharge the particles with the third smallest specific gravity between the third corner 214 and the fourth corner 215, going over the guides 220, and discharge the particles with the largest specific gravity between the first corner 212 and the third corner 214 along the guides 220.

In this case, the particles with the second smallest specific gravity are discharged between the third corner 214 and the fourth corner 215 and are discharged to the first discharge space 216 adjacent to the fourth corner 215.

Further, the particles with the third smallest specific gravity are discharged between the third corner 214 and the fourth corner 215 but have a lower moveable force than that of the particles with the largest specific gravity and thus are discharged to the second discharge space 217 adjacent to the third corner 214.

In this case, an angle formed by the first partition wall 280 and the second partition wall 290 or positions thereof are controlled, and thus a sorted amount of the particles with the second smallest specific gravity which are discharged to the first discharge space 216 may be controlled.

Figure 10:
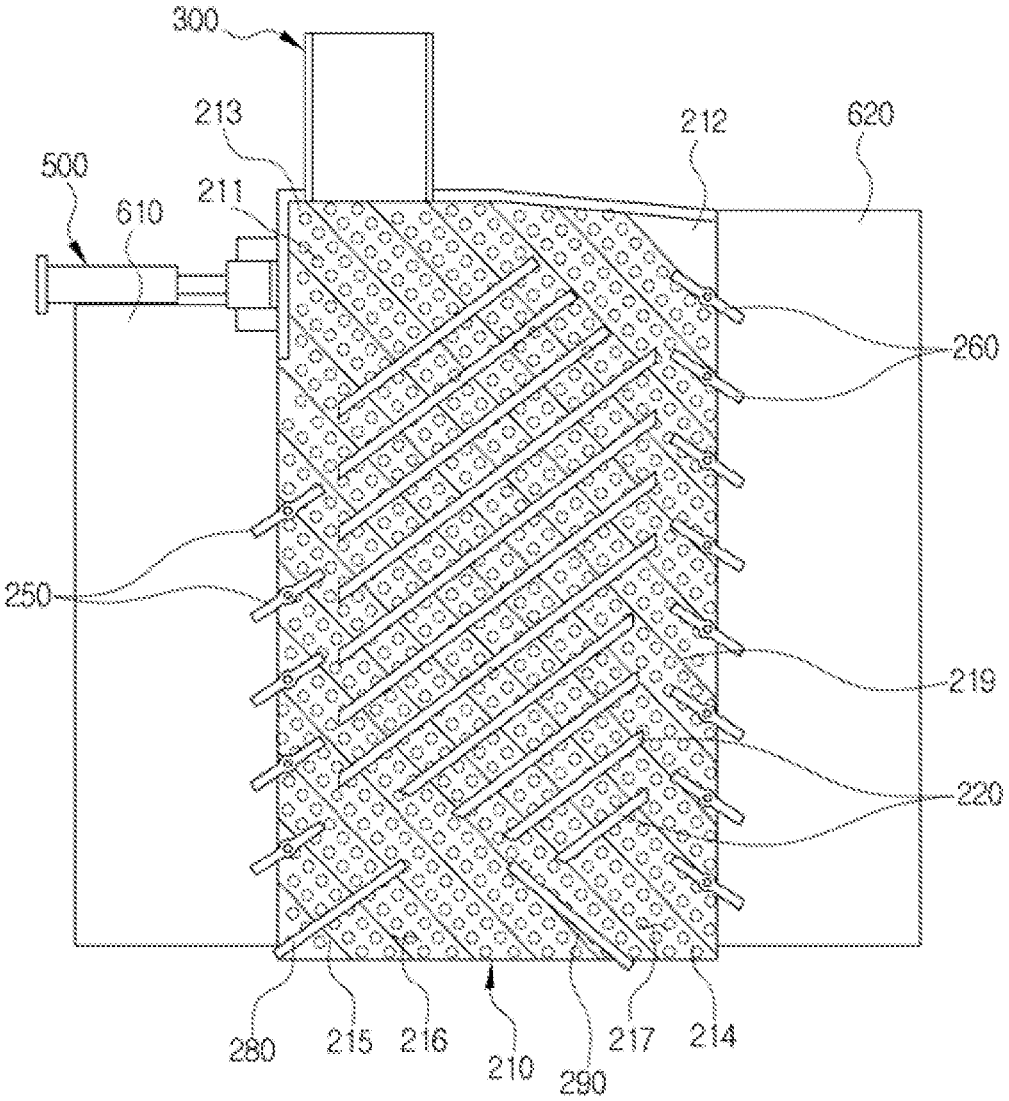
FIG. 10 is a plan view of a dry separation apparatus according to a second exemplary embodiment of the present invention.

FIG. 10 is a plan view of a dry separation apparatus according to a second exemplary embodiment of the present invention.

As illustrated in FIG. 10, the first deck 210 may be formed as a stepped surface 219 of which the top surface is stepped in a direction from the fourth corner 215 toward the first corner 212 to prevent the particles with a relatively larger specific gravity of the object to be separated from moving between the first corner 212 and the third corner 214.

Figure 11:
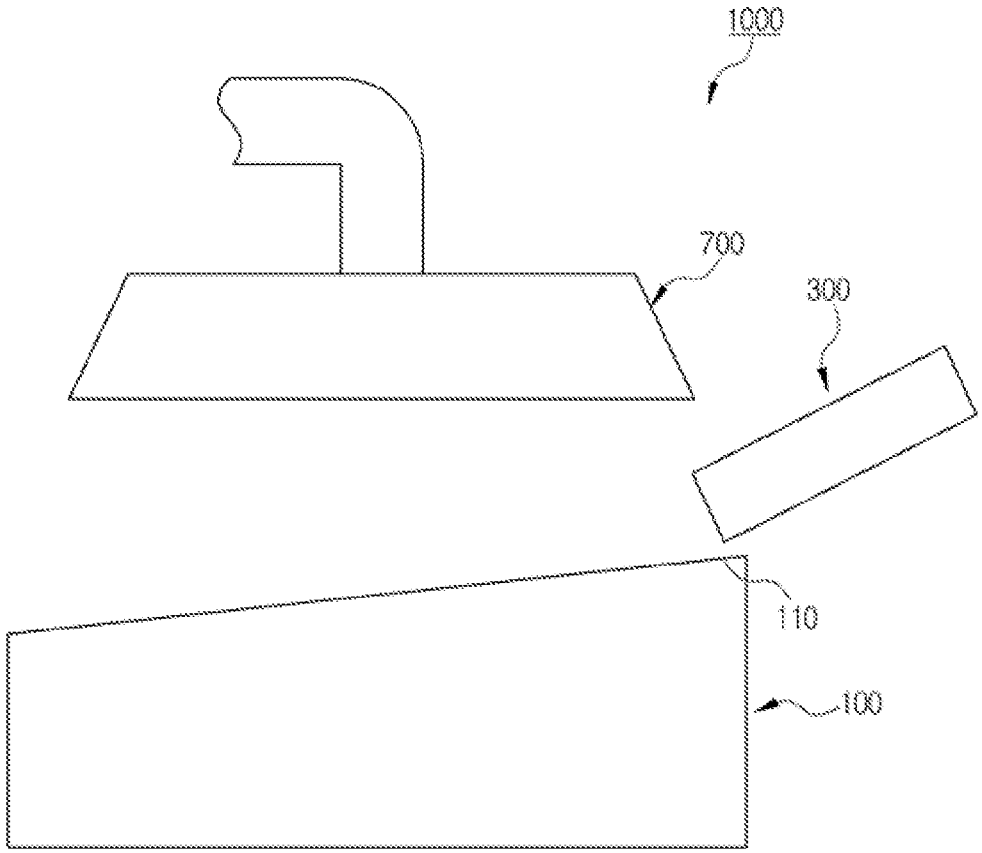
FIG. 11 is a schematic view of a dry separation apparatus according to a third exemplary embodiment of the present invention.

FIG. 11 is a side view of a dry separation apparatus according to a third exemplary embodiment of the present invention.

As illustrated in FIG. 11, the dry separation apparatus 1000 according to a third exemplary embodiment of the present invention may be configured to further include a suction part 700 which is installed over the main body 100 to suck dust generated during a process of sorting particles included in the object to be separated.

In this case, the suction part 700 may be configured as a vacuum suction device, but the present invention is not limited thereto.

Meanwhile, the dry separation apparatus 1000 according to the third exemplary embodiment of the present invention satisfies the following Equation 1 in the state in which a driving frequency of the air blow fan 400 is constant and a vibration frequency applied to the first deck 210 is constant.

$$CR=0.2173FR^2-7.6525FR+96.385 \quad \text{<Equation 1>}$$

(however, CR represents a recovery rate of particles to be recovered included in the object to be separated and FR represents a supply amount of the object to be separated per hour by the supply part 300, in which FR=2 to 6).

Further, the dry separation apparatus 1000 satisfies the following Equation 2 in the state in which the vibration frequency applied to the first deck 210 is constant and the supply amount of the object to be separated per hour by the supply part 300 is constant.

$$CR=0.0221ABF^2-1.4684ABF+91.983 \quad \text{<Equation 2>}$$

(however, CR represents a recovery rate of particles to be recovered included in the object to be separated and ABF represents a driving frequency of the air blow fan 400, in which ABF=30 to 60).

A dry separation method according to an exemplary embodiment of the present invention includes: a first step of supplying the object to be separated to the top surface of the first deck 210 which is inclinedly provided to one side in a front and rear direction and one side in a left and right direction and is provided with the plurality of punches 211; a second step of sending, by the air blow fan 400, air to the first punches 211; and a third step of horizontally vibrating, by the vibration part 500, the first deck 210 so as to discharge particles which have different specific gravities of the object to be separated and have a moveable force exerted by the air passing through the first punches 211 through different passages.

Further, in the second step, the air sent from the air blow fan 400 is split at a uniform size, passing through the second deck 230 which is provided between the first deck 210 and the air blow fan 400 and is provided with the plurality of second punches 231.

Further, in the second deck 230 the second punch 231 is formed to be wider than the first punch 211.

Further, in the third step, the particles with different specific gravities are discharged through different passages along the guide 220 which is coupled with the top surface of the first deck 210.

Further, the vibration part 500 is configured to include the angle control plate 510 which is hinged with the one side in the horizontal direction of the first deck 210 and the vibration member 520 which is installed at the angle control plate 510 to horizontally apply a vibration.

Further, the vibration part 500 is configured to include the piston 550 which periodically applies the horizontally pushing force to the first deck 210 to generate a vibration and the crank shaft 560 which horizontally reciprocates the piston.

Further, the first deck 210 has the top surface formed as the stepped surface 219.

Further, in the third step, the top surface of the first deck 210 is formed as the stepped surface 219 to prevent the particles with a large specific gravity of the particles with different specific gravities from being discharged in the same direction as the particles with a small specific gravity.

Further, the third step satisfies the following Equation 1 in the state in which the driving frequency of the air blow fan 400 is constant and the vibration frequency applied to the first deck 210 is constant.

$$CR=0.2173FR^2-7.6525FR+96.385 \quad \text{<Equation 1>}$$

(however, CR represents the recovery rate of particles to be recovered included in the object to be separated and FR represents the supply amount of the object to be separated per hour in the first step, in which FR=2 to 6).

Further, the third step satisfies the following Equation 2 in the state in which the vibration frequency applied to the first deck 210 is constant and the supply amount of crushed matters of run of mine coal in the object to be separated per hour in the step 1 is constant.

$$CR=0.0221ABF^2-1.4684ABF+91.983 \quad \text{<Equation 2>}$$

(however, CR represents the recovery rate of particles to be recovered included in the object to be separated and ABF represents the driving frequency of the air blow fan 400, in which ABF=30 to 60).

Hereinafter, the present invention will be described in detail based on the following experiment examples. In this case, in the present experiment examples, the object to be separated is selected as the crushed matters of run of mine coal.

Experimental Example 1

A grade of clean coal was evaluated based on a content of fixed carbon and ash which is included in the clean coal. That is, the clean coal in which the content of the fixed carbon is high and the content of the ash is low is evaluated as a high quality of clean coal. The content of the fixed carbon and the content of the ash have an inverse proportion relationship to each other. That is, when the content of the fixed carbon is high, the content of the ash is low and when the content of the fixed carbon is low, the content of the ash is high.

In the dry separation apparatus 1000 according to the exemplary embodiment of the present invention, a result of sorting a first run of mine coal sample in which a size is 1×5 mm, ash is 61.72%, and a quantity of heat is 2540 Cal/g and a second run of mine coal sample in which a size is 5×25 mm, ash is 58.04%, and a quantity of heat is 2849 Cal/g, in the state in which the inclined surface 110 of the main body 100 has an inclined angle of 3.5° in a front and rear direction and an inclined angle of 5.5° in a left and right direction is as the following Table 1.

TABLE 1

| Sample | Product | Production rate (wt %) | Ash (ash %) | Fixed carbon (F.C %) | Quantity of heat (cal/g) | Ash removal rate (%) | Recovery rate of flammable material (%) |
|---|---|---|---|---|---|---|---|
| First run of mine coal | Clean coal | 51 | 32.82 | 58.2 | 4797 | 75.24 | 81.71 |
| | Mixture of clean coal and gangue | 30 | 48.70 | 44.7 | 3780 | | |
| | Gangue | 19 | 86.90 | 5.75 | 1090 | | |
| Second run of mine coal | Clean coal | 30 | 35.30 | 63.3 | 4689 | 67.66 | 82 |
| | Mixture of clean coal and gangue | 25 | 40.50 | 53.4 | 4485 | | |
| | Gangue | 45 | 83.87 | 8.78 | 1380 | | |

As the result of sorting the first run of mine coal sample, the first run of mine coal was separated and sorted into the clean coal of 51%, the mixture of clean coal and gangue of 30%, and the gangue of 19%. In particular, the ash content of the clean coal was reduced from 61.72% which is the ash content of the first run of mine coal to 32.82%, and thus the ash removal rate of about 60.8% was achieved. Further, the quantity of heat of the clean coal of the first run of mine coal was increased from 2850 cal/g to 4690 cal/g.

That is, the dry separation apparatus 1000 according to the exemplary embodiment of the present invention may remove the gangue included in the crushed matters of the run of mine coal by simply sorting the specific gravity and does not require post-treatment facilities for drying and dehydration.

Experimental Example 2

In the dry separation apparatus 1000 according to the exemplary embodiment of the present invention, a result of sorting the crushed matters of the run of mine coal while changing the supply amount of crushed matters of the run of mine coal per hour by the run of mine coal supply part 300 in the state in which the inclined surface 110 of the main body 100 has an inclined angle of 3.5° in a front and rear direction and an inclined angle of 5.5° in a left and right direction, the driving frequency of the air blow fan 400 is constant, and the vibration frequency applied to the first deck 210 is constant is as the following Table 2.

TABLE 2

| Driving frequency of air blow fan (Hz) | Vibration frequency of first deck (Hz) | Supply amount of crushed matter of run of mine coal per hour by run of mine coal supply part (ton/hour) | Recovery rate of flammable material included in crushed matter of run of mine coal (%) |
|---|---|---|---|
| 50 | 45 | 2 | 81.71 |
| 50 | 45 | 2.5 | 82.00 |
| 50 | 45 | 3 | 72.44 |
| 50 | 45 | 3.5 | 69.49 |
| 50 | 45 | 4 | 68.70 |
| 50 | 45 | 4.5 | 68.60 |
| 50 | 45 | 5 | 67.57 |
| 50 | 45 | 5.5 | 58.03 |
| 50 | 45 | 6 | 57.99 |

As the result of sorting the crushed matters of the run of mine coal, the dry separation apparatus 1000 according to the exemplary embodiment of the present invention satisfied the following Equation 1 in the state in which the driving frequency of the air blow fan 400 is constant and the vibration frequency applied to the first deck 210 is constant.

$$CR=0.2173FR^2-7.6525FR+96.385 \quad \text{<Equation 1>}$$

(however, CR represents the recovery rate of flammable materials included in the crushed matters of the run of mine coal and FR represents the supply amount of crushed matters of the run of mine coal per hour by the run of mine coal supply part 300, in which FR=2 to 6).

In this case, as a result of calculating a correlation coefficient between numerical values of the above Table 2 and the above Equation 1, there was a correlation in which a value R2 of the correlation coefficient becomes high as much as 0.9013

Experimental Example 3

In the dry separation apparatus 1000 according to the exemplary embodiment of the present invention, a result of sorting the crushed matters of the run of mine coal while changing a driving frequency of the air blow fan 400 in the state in which the inclined surface 110 of the main body 100 has an inclined angle of 3.5° in a front and rear direction and an inclined angle of 5.5° in a left and right direction, the vibration frequency applied to the first deck 210 is constant, and the supply amount of crushed matters of the run of mine coal per hour by the run of mine coal supply part 300 is as the following Table 3.

TABLE 3

| Vibration frequency of first deck (Hz) | Supply amount of crushed matter of run of mine coal per hour by run of mine coal supply part (ton/hour) | Driving frequency of air blow fan (Hz) | Recovery rate of flammable material included in crushed matter of run of mine coal (%) |
|---|---|---|---|
| 45 | 2.5 | 30 | 67.57 |
| 45 | 2.5 | 35 | 68.60 |
| 45 | 2.5 | 40 | 68.70 |
| 45 | 2.5 | 45 | 69.49 |
| 45 | 2.5 | 50 | 72.44 |
| 45 | 2.5 | 55 | 81.71 |
| 45 | 2.5 | 60 | 82.00 |

As the result of sorting the crushed matters of the run of mine coal, the dry separation apparatus 1000 according to the exemplary embodiment of the present invention satisfied the following Equation 2 in the state in which the vibration frequency applied to the first deck 210 is constant and the supply amount of crushed matters of the run of mine coal per hour by the run of mine coal supply part 300 is constant.

$$CR=0.0221ABF^2-1.4684ABF+91.983 \quad \text{<Equation 2>}$$

(however, CR represents a recovery rate of flammable materials included in the crushed matters of the run of mine coal and ABF represents the driving frequency of the air blow fan 400, in which ABF=30 to 60).

In this case, as a result of calculating a correlation coefficient between numerical values of the above Table 3 and the above Equation 2, there was a correlation in which the value R2 of the correlation coefficient becomes high as much as 0.9178.

Experimental Example 4

In the dry separation apparatus 1000 according to the exemplary embodiment of the present invention, a result of sorting the crushed matters of the run of mine coal while changing the vibration frequency of the air blow fan 400 in the state in which the inclined surface 110 of the main body 100 has an inclined angle of 3.5° in a front and rear direction and an inclined angle of 5.5° in a left and right direction, the driving frequency of the air blow fan 400 is constant, and the supply amount of crushed matters of the run of mine coal per hour by the run of mine coal supply part 300 is constant is as the following Table 4.

TABLE 4

| Driving frequency of air blow fan (Hz) | Supply amount of crushed matter of run of mine coal per hour by run of mine coal supply part (ton/hour) | Vibration frequency of first deck (Hz) | Recovery rate of flammable material included in crushed matter of run of mine coal (%) |
|---|---|---|---|
| 50 | 2.5 | 30 | 67.57 |
| 50 | 2.5 | 35 | 68.60 |
| 50 | 2.5 | 40 | 68.70 |
| 50 | 2.5 | 45 | 82.00 |
| 50 | 2.5 | 50 | 81.71 |
| 50 | 2.5 | 55 | 72.44 |
| 50 | 2.5 | 60 | 69.49 |

As the result of sorting the crushed matters of the run of mine coal, the dry separation apparatus 1000 according to the exemplary embodiment of the present invention satisfied the following Equation 3 in the state in which the driving frequency of the air blow fan 400 is constant and the supply amount of crushed matters of the run of mine coal per hour by the run of mine coal supply part 300 is constant.

$$CR=-0.0447TF^2+4.2145TF-21.674 \quad \text{<Equation 3>}$$

(however, CR represents the recovery rate of flammable materials included in the crushed matters of the run of mine coal and TF represents the vibration frequency of the first deck 210).

In this case, as a result of calculating a correlation coefficient between numerical values of the above Table 4 and the above Equation 3, there was a correlation in which the value R2 of the correlation coefficient becomes slightly low as much as 0.5491.

The present invention is not limited to the above-mentioned exemplary embodiments, and may be variously applied, and may be variously modified without departing from the gist of the present invention claimed in the claims.

[Detailed Description of Main Elements]

1000: Dry separation apparatus according to the present invention
100: Main body
110: Inclined surface
210: First deck
211: First punch
212: First corner
213: Second corner
214: Third corner
215: Fourth corner
216: First discharge space
217: Second discharge space
219: Stepped surface
220: Guide
230: Second deck
231: Second punch
240: Frame
250: First ripple
260: Second ripple
270: Blocking wall
280: First partition wall
290: Second partition wall
300: Run of mine coal supply part
400: Air blow fan
500: Vibration part
510: Angle control plate
511: Long hole
520: Vibration member
530: Long bolt
540: Fixed nut
550: Piston
560: Crank shaft
610: First guide member
620: Second guide member
700: Suction part

The invention claimed is:

1. A dry separation apparatus, comprising:

a main body of which a top surface is formed as an inclined surface which is inclined to one side in a front and rear direction and one side in a left and right direction, the inclined surface being opened;

a first deck seated inside the inclined surface and provided with a plurality of first punches;

a plurality of guides coupled with a top surface of the first deck;

a supply part supplying an object to be separated to the top surface of the first deck;

an air blow fan installed inside the main body and sending air to the first punch; and a vibration part horizontally vibrating the first deck to discharge particles with a large specific gravity and particles with a small specific gravity of the object to be separated through different passages, wherein, when corners of the first deck are indicated as a first corner, a second corner, a third corner, and a fourth corner in a highly placed order, the dry separation apparatus further comprises: a first ripple arranged between the second corner and the fourth corner; a second ripple arranged between the first corner and the third corner; and a blocking wall enclosing the first corner and the second corner.

2. The dry separation apparatus of claim 1, further comprising:

a second deck provided between the first deck and the air blow fan and provided with a plurality of second punches which split the air sent from the air blow fan at a uniform size; and a frame inclinedly seated inside the inclined surface in an inclined direction of the inclined surface, while having the first deck and the second deck into a top surface and a bottom surface thereof, respectively.

3. The dry separation apparatus of claim 2, wherein in the second deck, the second punch is formed to be wider than the first punch.

4. The dry separation apparatus of claim 1, wherein the vibration part includes an angle control plate which is hinged with one side in a horizontal direction of the first deck and a vibration member which is installed at the angle control plate to horizontally apply a vibration.

5. The dry separation apparatus of claim 1, wherein the vibration part includes a piston which periodically applies a horizontally pushing force to the first deck to generate a vibration and a crank shaft which horizontally reciprocates the piston.

6. The dry separation apparatus of claim 1, further comprising:

a first partition wall located near the fourth corner;

a second partition wall located between the third corner and the fourth corner;

wherein the fourth corner and the third corner are partitioned into a first discharge space by the fourth corner and the second partition wall and a second discharge space by the third corner and the second partition wall, and the particles with the small specific gravity of the object to be separated supplied to the first deck are discharged to the first discharge space and the particles with a relatively larger specific gravity are discharged to the second discharge space.

7. The dry separation apparatus of claim 1, wherein the first deck has the top surface formed as a stepped surface.

8. The dry separation apparatus of claim 1, further comprising:

a suction part installed over the main body to suck dust generated during a sorting process.

9. The dry separation apparatus of claim 1, wherein the dry separation apparatus satisfies the following Equation 1 in a state in which a driving frequency of the air blow fan is constant and a vibration frequency applied to the first deck is constant:

$$CR=0.2173FR^2-7.6525FR+96.385 \quad \text{<Equation 1>}$$

(however, CR represents a recovery rate of particles to be recovered included in the object to be separated and FR represents a supply amount of the object to be separated per hour by the supply part, in which FR=2 to 6).

10. The dry separation apparatus of claim 1, wherein the dry separation apparatus satisfies the following Equation 2 in a state in which a vibration frequency applied to the first deck is constant and a supply amount of the object to be separated per hour by the supply part 300 is constant:

$$CR=0.0221ABF^2-1.4684ABF+91.983 \quad \text{<Equation 2>}$$

(however, CR represents a recovery rate of particles to be recovered included in the object to be separated and ABF represents a driving frequency of the air blow fan, in which ABF=30 to 60).

11. The dry separation apparatus of claim 1, wherein the object to be separated is a crushed matter of a run of mine coal.

* * * * *